US006663426B2

(12) United States Patent
Hasircoglu et al.

(10) Patent No.: US 6,663,426 B2
(45) Date of Patent: Dec. 16, 2003

(54) FLOATING INTERFACE FOR ELECTRICAL CONNECTOR

(75) Inventors: Alexander William Hasircoglu, Columbia, PA (US); Randall R. Henry, Harrisburg, PA (US); David Keay Fowler, Boiling Springs, PA (US); Lynn Robert Sipe, Mifflintown, PA (US); Attalee S. Taylor, Palmyra, PA (US); Jim Fedder, Ettels, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/042,635

(22) Filed: Jan. 9, 2002

(65) Prior Publication Data

US 2003/0129878 A1 Jul. 10, 2003

(51) Int. Cl.[7] ..... H01R 13/648
(52) U.S. Cl. ..... 439/608; 439/248; 439/79
(58) Field of Search ..... 439/608, 50, 62, 439/65, 67, 61, 248, 247, 91, 326–329, 77, 636–638, 492–499

(56) References Cited

U.S. PATENT DOCUMENTS

| | | | | |
|---|---|---|---|---|
| 5,951,315 | A | 9/1999 | Ichimura | 439/326 |
| 299,483 | A1 * | 10/2001 | Cohen et al. | 439/608 |
| 6,309,223 | B1 | 10/2001 | Wolfe | 439/67 |
| 6,347,950 | B1 | 2/2002 | Yokoyama et al. | 439/248 |
| 6,347,962 | B1 | 2/2002 | Kline | 439/608 |

* cited by examiner

*Primary Examiner*—Alexander Gilman

(57) ABSTRACT

An electrical connector has been provided that includes a housing having a base having a rear end and an interface end. The base includes at least one channel extending between the rear and interface ends. The electrical connector also includes at least one conductive wafer configured to engage electrical contacts. Each conductive wafer is divided into a rear portion and an interface portion. The rear portion is received and securely retained in a channel with the interface portion extending beyond the interface end of the base. The interface portion moves in a direction transverse to a plane of the conductive wafer to facilitate alignment with a mating structure.

35 Claims, 14 Drawing Sheets

210
290
292
22
24
12
14
110
117
112
113
A
F

FLOATING INTERFACE FOR ELECTRICAL CONNECTOR

BACKGROUND OF THE INVENTION

Certain embodiments of the present invention generally relate to improvements in electrical connectors that connect printed circuit boards to one another and more particularly relate to electrical connectors that include floating interfaces to ensure proper contact between components of the connectors.

Various electronic systems, such as computers, comprise a wide array of components mounted on printed circuit boards, such as daughterboards and motherboards, which are interconnected to transfer signals and power throughout the systems. The transfer of signals and power between the circuit boards requires electrical connectors between the circuit boards. Typical connector assemblies include a plug connector and a receptacle connector. Each plug and receptacle connector may house a plurality of electrical wafers. An electrical wafer may be a thin printed circuit board or a series of laminated contacts within a plastic carrier. The electrical wafers within one connector may communicate with the electrical wafers in the other connector through a backplane. Alternatively, the electrical wafers may edge mate in an orthogonal manner obviating the need for a backplane.

Electrical wafers, however, may be misaligned within the connectors that house the wafers. The misalignment may be caused by manufacturing processes used to manufacture the wafers and/or connectors. The misalignment between two wafers that mate with one another may cause a poor connection, and thus a poor signal path, between the wafers. For example, forming mounting channels, into which the electrical wafers are received, in one connector may produce a possible misalignment with a counterpart wafer in the other connector. That is, one connector may have channels with a first tolerance, while the other connector may have channels having a similar or different tolerance. Added together, the tolerances may provide a wide range of motion over which the wafers may move. If the wafers move too much over the range of motion, a poor electrical connection may result between mating wafers. That is, if two wafers mate with each other at an angle that provides poor contact between the wafers, the electrical connection between the two wafers may be less than desired, or non-existent. Additionally, over time, connectors may warp due to stresses and strains within the systems in which they are utilized. When a wafer is misaligned with a counterpart wafer to which it is supposed to mate, signals between the wafers may be attenuated, diminished, or even completely blocked. Also, misalignment may occur within a connector system using conventional contacts.

Thus a need has existed for an electrical connector that maintains proper contact between wafers and/or contacts included within a first connector and those in a second connector. Specifically, a need has existed for an electrical connector that maintains proper alignment, and corrects misalignments, between circuit boards, or wafers, within a first connector and those of a second connector housing.

BRIEF SUMMARY OF THE INVENTION

In accordance with an embodiment of the present invention, a connector assembly has been developed that includes a first connector mated with a second connector. Each connector includes a housing and at least one conductive wafer configured to engage electrical contacts. The housing includes a base having a rear end and an interface end. The base also includes at least one channel extending between the rear and interface ends. Each conductive wafer is divided into a rear portion and an interface portion. The rear portion is received and securely retained in a channel with the interface portion extending beyond the interface end of the base. The interface portion includes a contact edge. The interface portion moves in a direction that is transverse to a plane of the conductive wafer in order to facilitate alignment with a mating structure, such as another conductive wafer.

Certain embodiments of the present invention may also include flex limiting wedges positioned on either side of a channel at the interface end. The flex limiting wedges define a range of motion over which the interface portion moves.

Certain embodiments of the present invention may also include an interface housing, which receives and securely retains the interface portion of the conductive wafer. The interface housing moves in the same direction as the interface portion of the conductive wafer.

Figure 1:
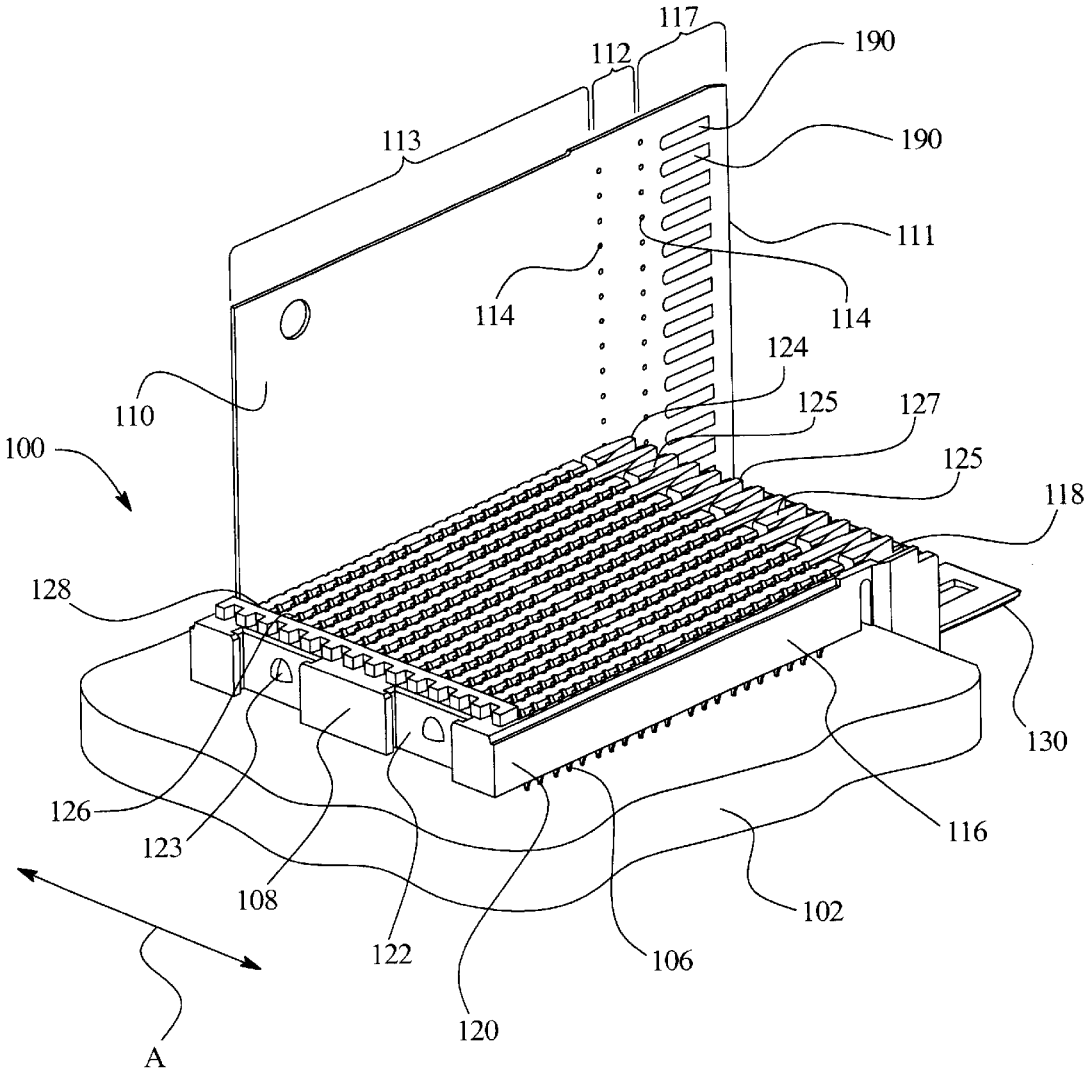
FIG. 1 is an isometric view of an interior of a receptacle connector formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 is an isometric view of an interior of a receptacle connector 100 formed in accordance with an embodiment of the present invention. The receptacle connector 100 includes a base 120 and receptacle circuit boards, or wafers 110 (although only one receptacle wafer 110 is shown in FIG. 1) having a rear portion 113, a flex portion 112 and an interface portion 117. The base 120 includes an interface side 118, side walls 116 and a rear wall 108. The rear wall 108 includes cover mating notches 122 having latch mating members 123 that receive and retain cover latches (not shown) formed on a cover (not shown). Latch members 130 extend outwardly from the bottom of the base 120 at the interface side 118. The latch members 130 may be integrally formed with the base 120, or they may be separate structures mounted on the base 120. The base 120 also includes channels 128 extending along a length thereof. Each channel 128 includes a series of receptacles 126. Each receptacle 126 retains a compliant contact 106. Each compliant contact 106 includes a single prong that extends down through the bottom of the base 120, and a double prong (not shown) that extends up through the top of the base 120. Each channel 128 is closed by the rear wall 108 and open at the interface side 118. At the interface side 118, each channel 128 is positioned between flex limiting wedges 124. The flex limiting wedges 124 are formed such that a wide end 125 distal to the interface side 118 is wider than a tapered end 127 proximal to the interface side 118. Alternatively, the flex limiting wedges 124 may be included within an interior of a floating interface housing 620 (shown with respect to FIG. 6), instead of within the base 120.

Each channel 128 receives and retains a receptacle circuit board, or wafer 110. Each receptacle wafer 110 includes a base mating edge (hidden by insertion of the receptacle wafer 110 into the channel 128) and plug mating edge 111. The base mating edge has signal and contact pads (not shown), and the plug mating edge 111 also has signal contact pads 190, and ground contact pads (on opposite side of receptacle wafer 110). As shown in FIG. 1, the plug mating edge 111 is located at the edge of the interface portion 117. Signal and ground terminals, or contact members, 22 and 12, respectively, (as shown with respect to FIGS. 3 and 4) connect to contact pads on the plug mating edge 111. That is, signal terminals 22 contact signal contact pads 190, while ground terminals 12 contact ground contact pads. The contact pads (not shown) of the base mating edge are positioned between double prongs (not shown) of compliant contacts 106. That is, the double prongs straddle the receptacle wafer 110 and contact it at contact pads located on the base mating edge. The compliant contacts 106 in turn connect to a printed circuit board 102 through receptacles (not shown) formed in the printed circuit board 102 that receive and retain single prongs (not shown) of the compliant contacts 106. Thus, an electrical path may be established between the printed circuit board 102 and the receptacle wafer 110.

A rear portion 113 of a receptacle wafer 110 is securely retained in a channel 128. The receptacle wafer 110 is securely retained from the rear portion 113 to the flex portion 112. Flex holes 114 are formed in each receptacle wafer 110. The flex holes 114 are formed in one or more columns extending in a direction transverse to a length of the channels 128. The area between the columns of flex holes 114 is approximately the length of the flex limiting wedge 124, such that one column of flex holes 114 is proximate to the wide end 125 of a flex limiting wedge 124, while the other column of flex holes 114 is proximate to a tapered end 127 of the flex limiting wedge 124. While the receptacle wafer 110 may be covered with a solder mask, the solder mask may be removed at the flex portion 112 to provide added flexibility in the flex portion 112. Additionally, the flex holes 114 provide a weakened area in the receptacle wafer 100 such that the area between the flex holes 114, that is the flex portion 112, may flex easier than the rear portion 113 or the interface portion 117 of the receptacle wafer 110. Also, copper in the flex portion 112 may be removed to provide further weakening of the flex portion 112.

The flexion of each flex portion 112 is limited by the flex limiting wedges 124, which are positioned on either side of the receptacle wafer 110. As mentioned above, the flex limiting wedges 124 may be included within the base 120 or the interior of the floating interface housing 620. Because the tapered end 127 of each flex limiting wedge 124 is thinner than the wide end 125, the receptacle wafer 110 may flex between the tapered ends 127 of two flex limiting wedges 124 that are positioned on either side of the receptacle wafer 110. Line A denotes the directions in which the flex portions 112 may flex, and the interface portions 117 may move. That is, the flex portions 112 of the receptacle wafers 110 may flex horizontally (as shown in FIG. 1), or in a direction perpendicular to the plane of the receptacle wafers 110. The flexion of the flex portions 112 is limited by the flex limiting wedges 124. Thus, the movement of the interface portions 117 is limited by the flex limiting wedges 124. Each tapered end 127 acts as a physical barrier beyond which a flex portion 112 of a receptacle wafer 110 cannot flex. The portion of the flex portion 112 proximate the tapered ends 127 of two flex limiting wedges 124 may flex over a greater range of motion as compared to the portion of the flex portion 112 proximate the corresponding wide ends 125. While the flex portion 112 of a receptacle wafer 100 may flex, the rear portion 113 and the interface portion 117 of the receptacle wafer 110 remain rigid and straight, relative to the flexion of the flex portion 112. That is, the rear portion 113 is securely retained by the channel 128, while the interface portion 117 is securely retained in interface slots of a floating interface housing 620, as shown with respect to FIG. 6. However, the interface portion 117 moves out of the plane of the rear portion 113 in response to the flexion of the flex portion 112. That is, while the interface portion 117 may move, it remains relatively straight and rigid, as compared to the flex portion 112.

Figure 2:
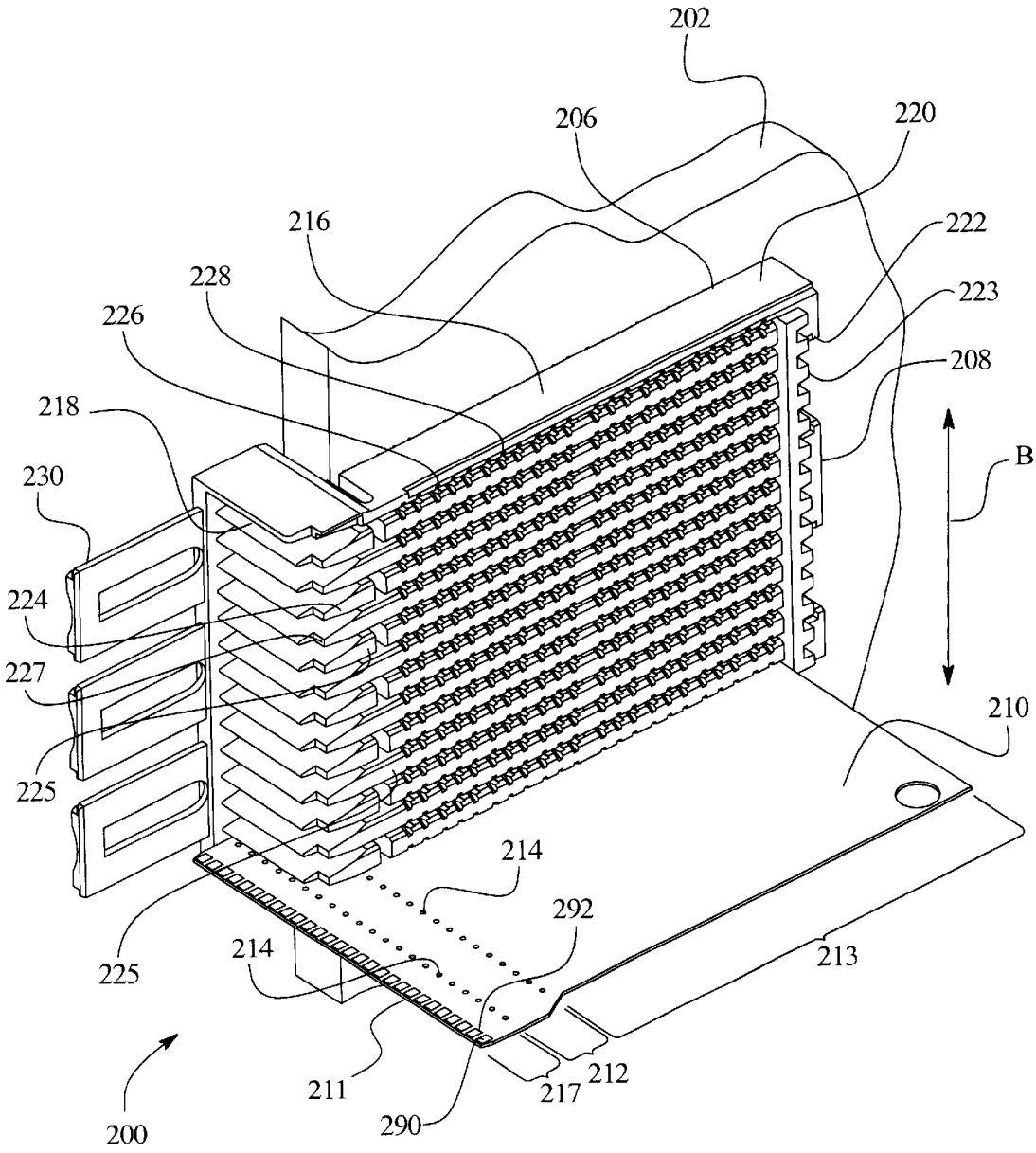
FIG. 2 is an isometric view of an interior of a plug connector formed in accordance with an embodiment of the present invention.

FIG. 2 is an isometric view of an interior of a plug connector 200 formed in accordance with an embodiment of the present invention. The plug connector 200 includes a base 220 and plug circuit boards, or wafers 210 (although only one plug wafer 210 is shown in FIG. 2) having a rear portion 213, a flex portion 212 and an interface portion 217. The base 220 includes an interface side 218, side walls 216 and a rear wall 208. The rear wall 208 includes cover mating notches 222 having latch mating members 223 that receive and retain cover latches (not shown) formed on a cover (not shown). Latch members 230 extend outwardly from the bottom of the base 220 at the interface side 218. The latch members 230 may be integrally formed with the base 220, or they may be separate structures mounted on the base 220. The base 220 also includes channels 228 extending along a length thereof. Each channel 228 includes a series of receptacles 226. Each receptacle 226 retains a compliant contact 206. Each compliant contact 206 includes a single prong (not shown) that extends down through the bottom of the base 220, and a double prong (not shown) that extends up through the top of the base 220. Each channel 228 is closed by the rear wall 208 and open at the interface side 218. At the interface side 218, each channel 228 is positioned between flex limiting wedges 224. The flex limiting wedges 224 are formed such that a wide end 225 distal to the interface side 218 is wider than a tapered end 227 proximal to the interface side 218. Alternatively, the flex limiting wedges 224 may be included within an interior of a floating interface housing 720 (shown with respect to FIG. 7), instead of within the base 220.

Each channel 228 receives and retains a plug circuit board, or wafer 210. Each plug wafer 210 includes a base mating edge (hidden by insertion of the plug wafer 210 into the channel 128) and plug mating edge 211. The base mating edge has signal and contact pads (not shown), while the plug mating edge 211 has signal contact pads 290 and ground contact pads 292. As shown in FIG. 2, the plug mating edge 211 is located at the edge of the interface portion 217. Signal and ground terminals, or contact members, 22 and 12, respectively (as shown with respect to FIGS. 3 and 4) connect to contact pads 290 and 292, respectively, on the plug mating edge 211. The contact pads of the base mating edge are positioned between double prongs (not shown) of compliant contacts 206. That is, the double prongs straddle the plug wafer 210 and contact it at contact pads located on the base mating edge. The compliant contacts 206 in turn connect to a printed circuit board 202 through receptacles (not shown) formed in the printed circuit board 202 that receive and retain single prongs (not shown) of the compliant contacts 206. Thus, an electrical path may be established between the printed circuit board 202 and the plug wafer 210.

A rear portion 213 of a plug wafer 210 is securely retained in a channel 228. The plug wafer 210 is securely retained from the rear portion 213 to the flex portion 212. Flex holes 214 are formed in each plug wafer 210. The flex holes 214 are formed in one or more columns extending in a direction transverse to a length of the channels 128. The area between the columns of flex holes 214 is approximately the length of the flex limiting wedge 224, such that one column of flex holes 214 is proximate to the wide end 225 of the flex limiting wedge 224, while the other column of flex holes 214 is proximate to the tapered end 227 of the flex limiting wedge 224. While the plug wafer 210 may be covered with a solder mask, the solder mask may be removed at the flex portion 212 to provide added flexibility in the flex portion 212. Additionally, the flex holes 214 provide a weakened area in the plug wafer 210 such that the area between the flex holes 214, that is the flex portion 212, may flex easier than the rear portion 213 or the interface portion 217 of the plug wafer 210.

The flexion of each flex portion 212 is limited by the flex limiting wedges 224, which are positioned on either side of the plug wafer 210. Because the tapered end 227 of each flex limiting wedge 224 is thinner than the wide end 225, the plug wafer 210 may flex between the tapered ends 227 of two flex limiting wedges 224 that are positioned on either side of the plug wafer 210. Line B denotes the directions in which the flex portions 212 may flex, and the interface portions 217 may move. That is, the flex portions 212 of the plug wafers 210 may flex vertically (as shown in FIG. 1), or in a direction perpendicular to the plane of the plug wafers 210. The flexion of the flex portions 212 is limited by the flex limiting wedges 224. Each tapered end 227 acts as a physical barrier beyond which the receptacle wafer 210 cannot flex. The portion of the flex portion 212 proximate the tapered ends 227 of two flex limiting wedges 224 may flex over a wider range of motion as compared to the portion of the flex portion 212 proximate the corresponding wide ends 225 due to the tapered nature of the flex limiting wedges 224. While the flex portion 212 of a plug wafer 210 may flex, the rear portion 213 and the interface portion 217 of the plug wafer 210 remain rigid and fixed. That is, the rear portion 213 is securely retained by the channel 228, while the interface portion 217 is securely retained in interface slots of a floating interface housing 720. However, the interface portion 217 moves out of the plane of the rear portion 213 in response to the flexion of the flex portion 212. That is, while the interface portion 217 may move, it remains relatively straight and rigid, as compared to the flex portion 212.

Figure 3:
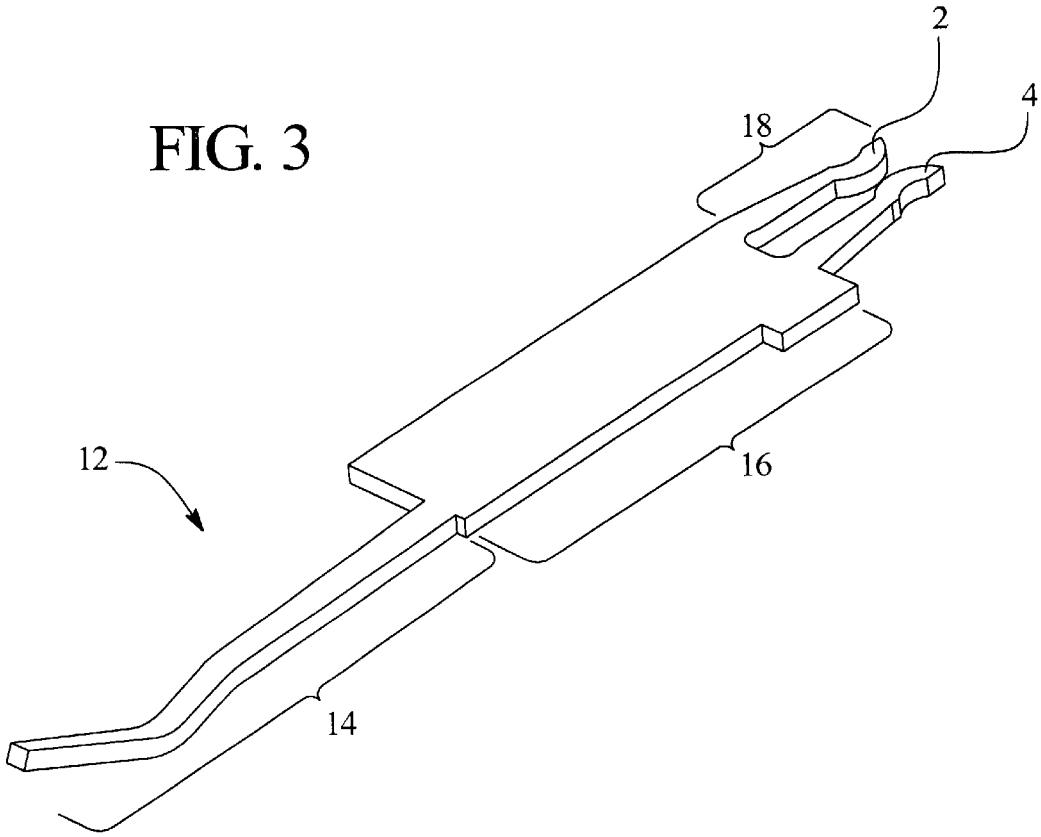
FIG. 3 is an isometric view of a ground terminal formed in accordance with an embodiment of the present invention.

FIG. 3 is an isometric view of a ground terminal, or ground contact member, 12 formed in accordance with an embodiment of the present invention. The ground terminal 12 includes a single beam receptacle interconnect 14 on one end of an intermediate portion 16 and a plug ground interconnect 18 shaped like a tuning fork on the opposite end. The plug ground interconnect 18 includes two prongs 2 and 4. Therefore one prong 2 of the plug ground interconnect 18 contacts a ground contact pad 292 on one side of the plug wafer 210 while the other prong 4 of the plug ground interconnect 18 contacts a ground contact pad 292 on the other side of the plug wafer 210. That is, the plug wafer 210 is straddled by receptacle ground interconnects 18. The single beam receptacle interconnect 14 contacts a ground contact pad (not shown) located on one side of the receptacle wafer 110.

Figure 4:
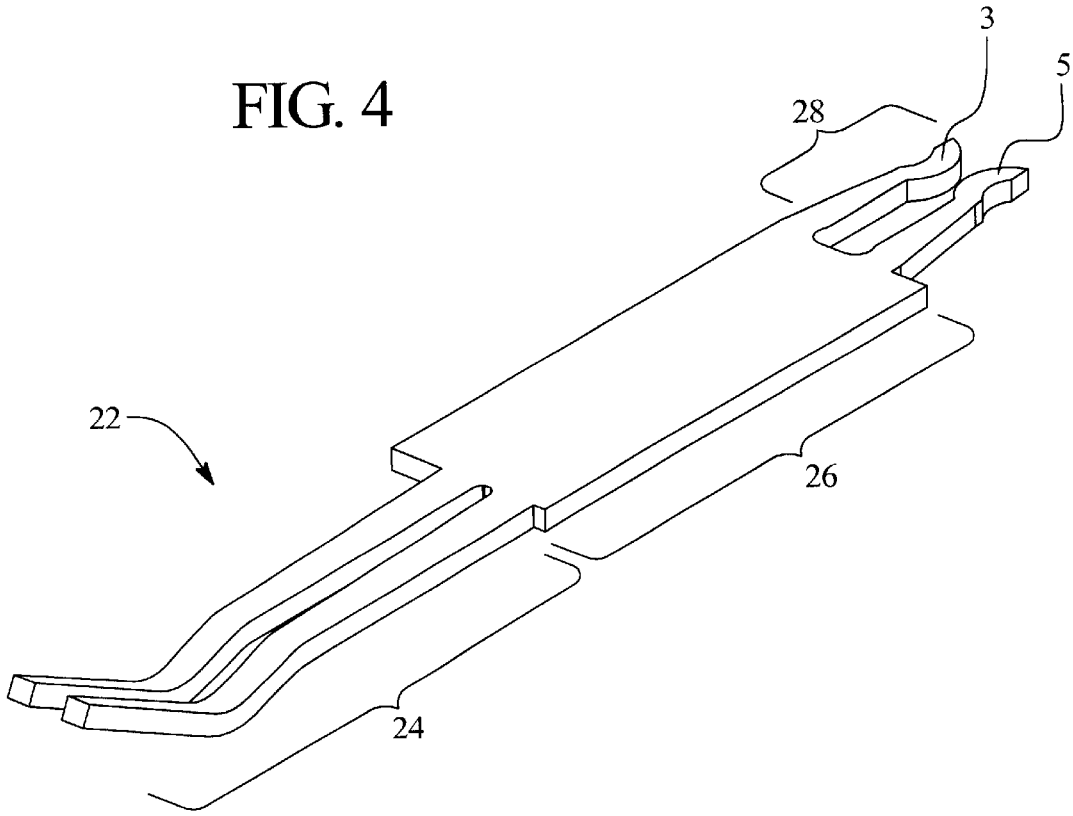
FIG. 4 is an isometric view of a signal terminal formed in accordance with an embodiment of the present invention.

FIG. 4 is an isometric view of a signal terminal, or signal contact member, 22 formed in accordance with an embodiment of the present invention. The signal terminal 22 includes a double beam receptacle interconnect 24 on one side of an intermediate portion 26 and a plug signal interconnect 28 shaped like a tuning fork on the opposite end. The plug signal interconnect 28 includes two prongs 3 and 5. Therefore one prong 3 of the plug signal interconnect 28 contacts a signal contact pad 290 on one side of the plug wafer 210 while the other prong of the plug signal interconnect 28 contacts a signal contact pad 290 on the other side of the plug wafer 210. That is, the plug wafer 210 is straddled by the plug signal interconnect 28. The double beam receptacle interconnect 24 contacts a signal contact pad 190 located on one side of the receptacle wafer 110. That is, both beams of the receptacle interconnect 24 contact one signal contact pad 190 located on one side of the receptacle wafer 110.

Figure 5:
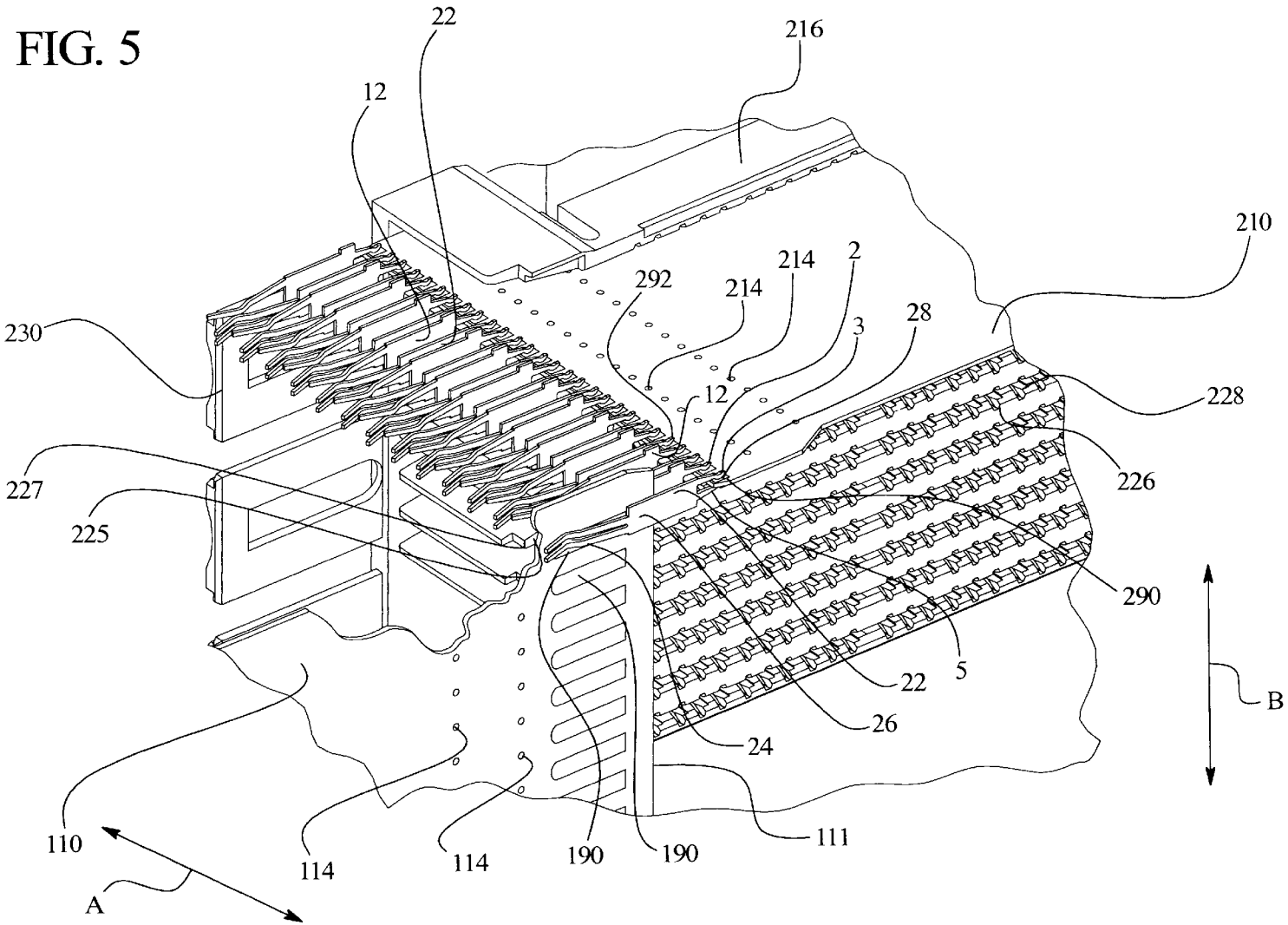
FIG. 5 is an isometric interior view of a receptacle wafer orthogonally mated with a plug wafer according to an embodiment of the present invention.

FIG. 5 is an isometric interior view of a receptacle wafer 110 orthogonally mated with a plug wafer 210 according to an embodiment of the present invention. As shown in FIG. 5, the signal terminal 22, through the double beam receptacle interconnect 24, engages a signal contact pad 190 on the receptacle wafer 110 on a first side, while the ground terminal 12, through the single beam receptacle interconnect 14 engages a ground contact pad (on hidden side of receptacle wafer 110) on the same receptacle wafer 110 on a second side. However, the plug signal interconnect 28, through the prongs 3 and 5, straddles the plug wafer 210 such that the signal terminal 22 engages signal contact pads 290 on both sides of the plug wafer 210. Similarly, the plug ground interconnect 18, through the prongs 2 and 4, straddles the plug wafer 210 such that the ground terminal 12 engages ground contact pads 292 on both sides of the plug wafer 210. Thus, the receptacle wafer 110 is positioned between a plurality of signal terminals 22 on one side of the receptacle wafer 110 and a plurality of ground terminals 12 on a second side of the receptacle wafer 110. A plug wafer 210, on the other hand, is positioned between a plurality of signal and ground terminals 22 and 12, each of which contacts the plug wafer 210 on both sides.

Figures 8A, 8B, 8C:
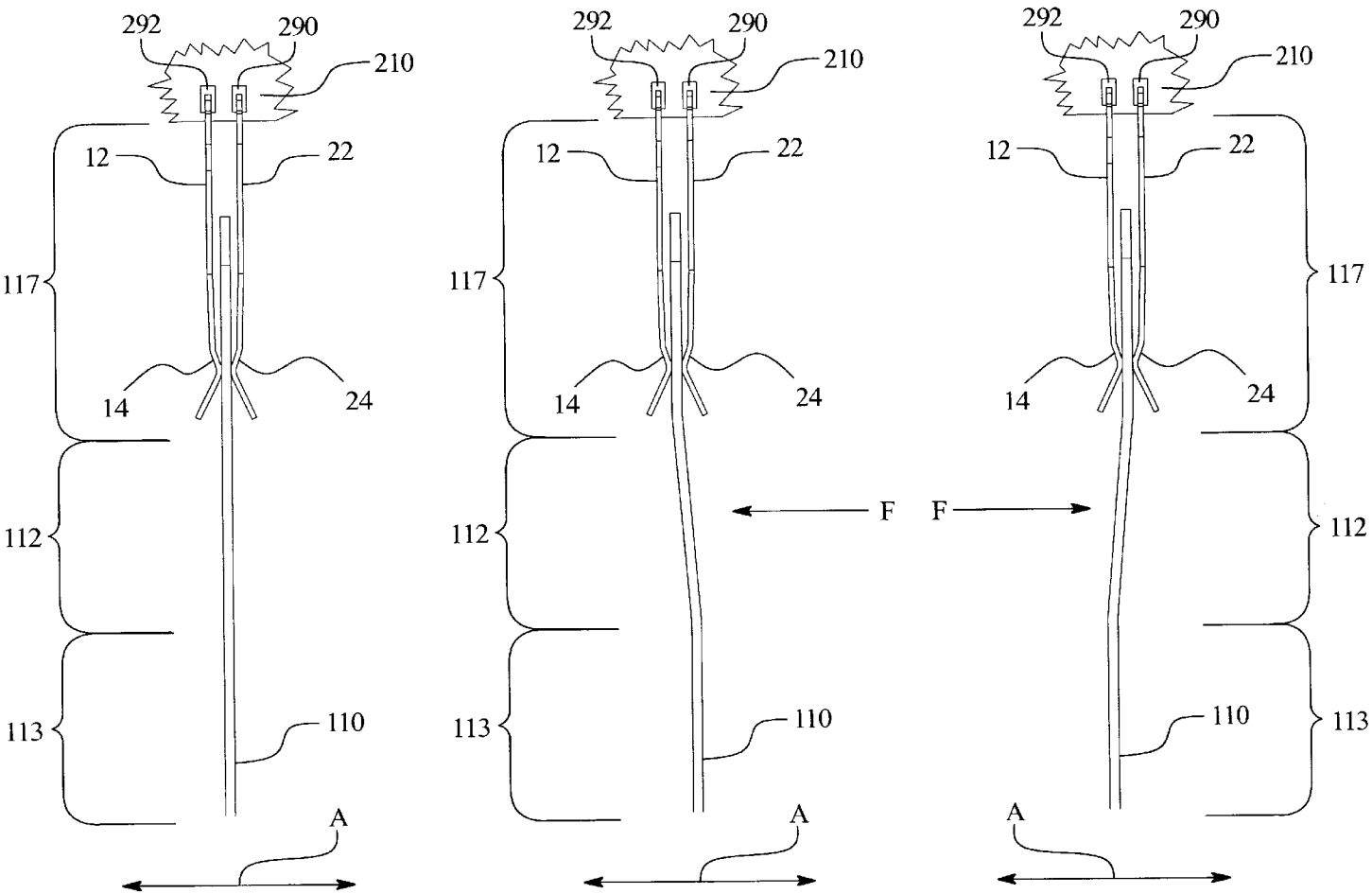
FIG. 8 illustrates a top view of a receptacle wafer mated with a plug wafer according to an embodiment of the present invention.

FIG. 8 illustrates a top view of a receptacle wafer 110 mated with a plug wafer 210 according to an embodiment of the present invention. In FIG. 8, most of the supporting structure, such as the flex limiting wedges 124 and 224, is not shown. FIG. 8*a* shows a receptacle wafer 110 in a substantially straight alignment. That is, no lateral forces are warping the receptacle wafer 110, or forcing the flex portion 112 to flex. In FIGS. 8*b* and 8*c*, however, lateral forces (F) are exerted on the receptacle wafer 110. The movement of the signal terminal 22 and ground terminal is exaggerated to better show the movement of the flex portion 112. As shown in FIGS. 8*b* and 8*c*, only the flex portion 112 flexes, while the rear and interface portions 113, 117 of the receptacle wafer 110 remain in a straight alignment. However, the interface portion 117 moves (but does not flex) relative to the rear portion 113 in response to the flexion of the flex portion 112.

Figure 9A:
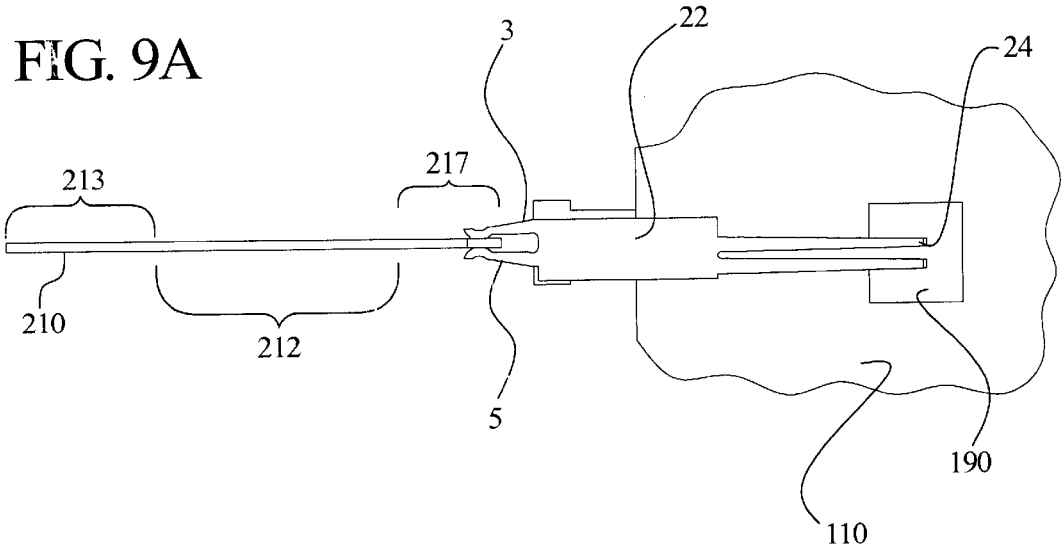
FIG. 9 illustrates a side view of a receptacle wafer mated with a plug wafer according to an embodiment of the present invention.
Figure 9B:
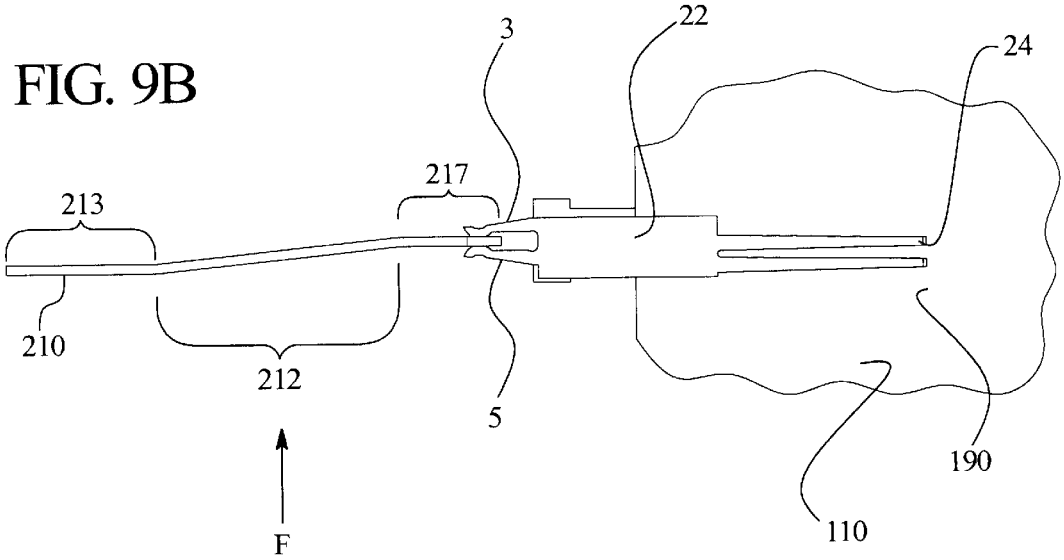
Figure 9C:
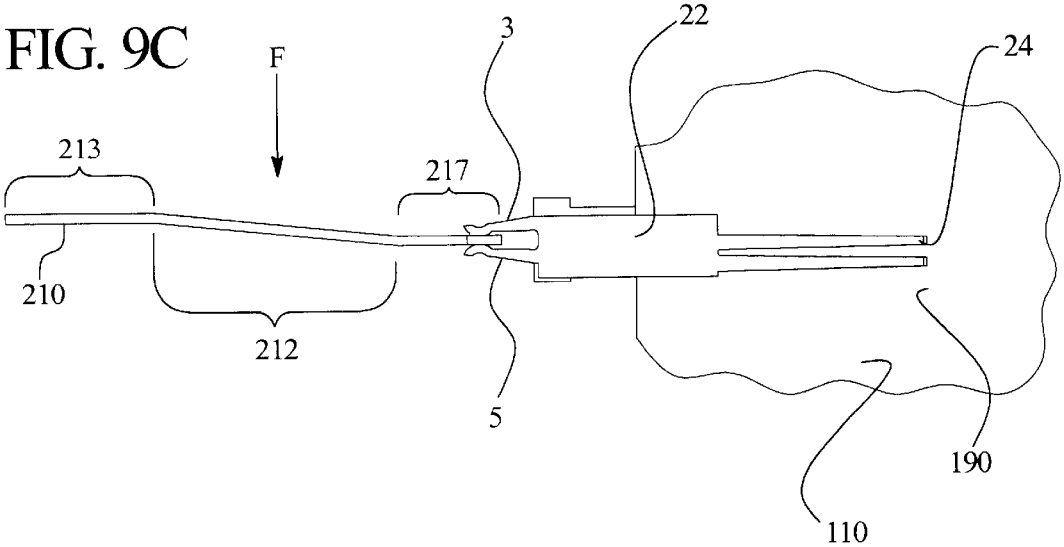

FIG. 9 illustrates a side view of a receptacle wafer 110 mating with a plug wafer 210 according to an embodiment of the present invention. In FIG. 9, most of the supporting structure, such as the flex limiting wedges 124 and 224, is not shown. FIG. 9*a* shows a plug wafer 210 in a substantially straight alignment. That is, no upward or downward forces are warping the plug wafer 210, or forcing the flex portion 212 to flex. As in FIG. 8, the movement in FIG. 9 is exaggerated. In FIGS. 9*b* and 9*c* upward and downward forces are exerted on the plug wafer 210. The forces cause the signal terminal 22 and the ground terminal 12 (ground terminal 12 hidden in FIG. 9), which clip to the plug wafer 110 through prongs 3 and 5, in the case of the signal terminal 22, and prongs 2 and 4, in the case of hidden ground terminal 12, to move in response to the force. Prongs 3, 5 and 2, 4 may also flex. For example, the prongs 3,5 and 2, 4 may flex by an amount depending on the flex of the flex portion 212. As shown in FIGS. 8*b* and 8*c*, only the flex portion 212 flexes, while the rear and interface portions 213, 217 of the plug wafer 210 remain in a straight alignment. However, the interface portion 217 moves (but does not flex) relative to the rear portion 213 in response to the flexion of the flex portion 212.

Figure 6:
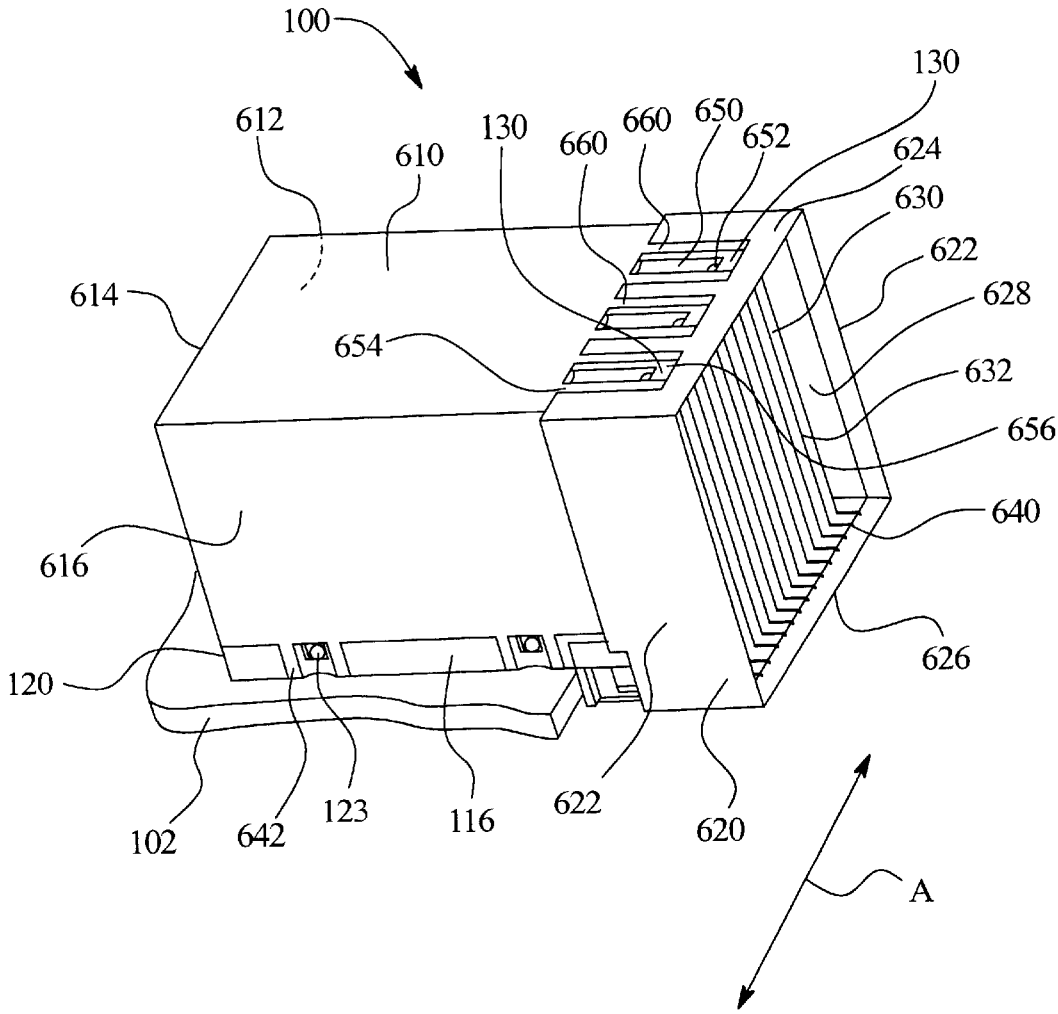
FIG. 6 is an isometric view of a receptacle connector formed in accordance with an embodiment of the present invention.

FIG. 6 is an isometric view of a receptacle connector 100, without receptacle wafers 110, formed in accordance with an embodiment of the present invention. The receptacle connector includes the base 120, a floating interface housing 620 and a cover 610. The floating interface housing 620 has latch recesses 650 having latch projections 652 protruding therefrom and latch flexion limiting lips 660. The floating interface housing 620 also includes side walls 622, a top wall 624, a wafer projection wall 630 and a bottom wall 626, which define an interface cavity 628. The latch recesses 650 and latch projections 652 are formed on the exterior of the top wall 624 and the bottom wall 626. The wafer projection wall 630 includes slots 632 extending from the top wall 624 to the bottom wall 626. The slots 632 allow the receptacle wafers 110 to pass through. The side of the bottom wall 626 within the interface cavity 628 includes guide slots 640 that receive and securely retain lower edges of the interface portions 117 of the receptacle wafers 110. Additionally, the side of the top wall 624 facing the interface cavity 628 may also include guide slots that receive and securely retain upper edges of the interface portions 117 of the receptacle wafers 110. Thus, upon complete assembly of the receptacle connector 100, each receptacle wafer 110 is fixed in a straight orientation at its rear portion 113 and its interface portion 117. Only the flex portion 112 of each receptacle wafer 110 flexes, while the rear portion 113 and the interface portion 117 remain relatively rigid and straight as compared to the flex portion 112. However, as mentioned above, while the interface portion 117 remains in a straight orientation, the interface portion 117 moves in response to the flexing of the flex portion 112.

The cover 610 includes a top wall 612, side walls 616, a rear wall 614, latch members 130 and cover latches 642. An open cavity (not shown) is defined by the walls 612, 616 and 614. In FIG. 6, the latch mating members 123 and cover mating notches 122 are formed on the side walls 116 of the base 120. As shown in FIG. 1, however, the latch mating members 123 and cover mating notches 122 may be formed on the rear wall 108 of the base 120. Alternatively, these features may be located on the side walls 116 and the rear wall 108. The cover latches 642 are oriented on the cover 610 to correspond to the position(s) of the cover mating notches 122 and the latch mating members 123. The cover latches 642 are received by the cover mating notches 122 and retained by the latch mating members 123. Optionally, instead of using a latching system to fasten the cover 610 to the base 120, the cover 122 may be fastened to the base 120 through screws, glue, and the like.

The latch members 130 may be integrally formed with the top wall 612 of the cover 610, or they may be separately mounted on the top wall 612. The latch members 130 on the cover 610 and on the base 120 have a flex end 656 and a retained end 654. The latch members 130 engage the latch recesses 650 and mate with the latch projections 652. The retained ends 654, which are retained by the latch recesses 650, remain fixed while the flex ends 656 may move, relative to the actual movement of the floating interface housing 620, in the directions denoted by line A. That is, the flex ends 656, because they are connected or formed integrally with the stationary cover 610 or base 120, do not actually move. The floating interface housing 620 moves, which produces relative motion between the flex ends 656 and the floating interface housing 620. The movement of the flex ends 656 is limited by the latch flexion limiting lips 660, which form a barrier that impedes continued movement of the latch members 130.

Figure 14:
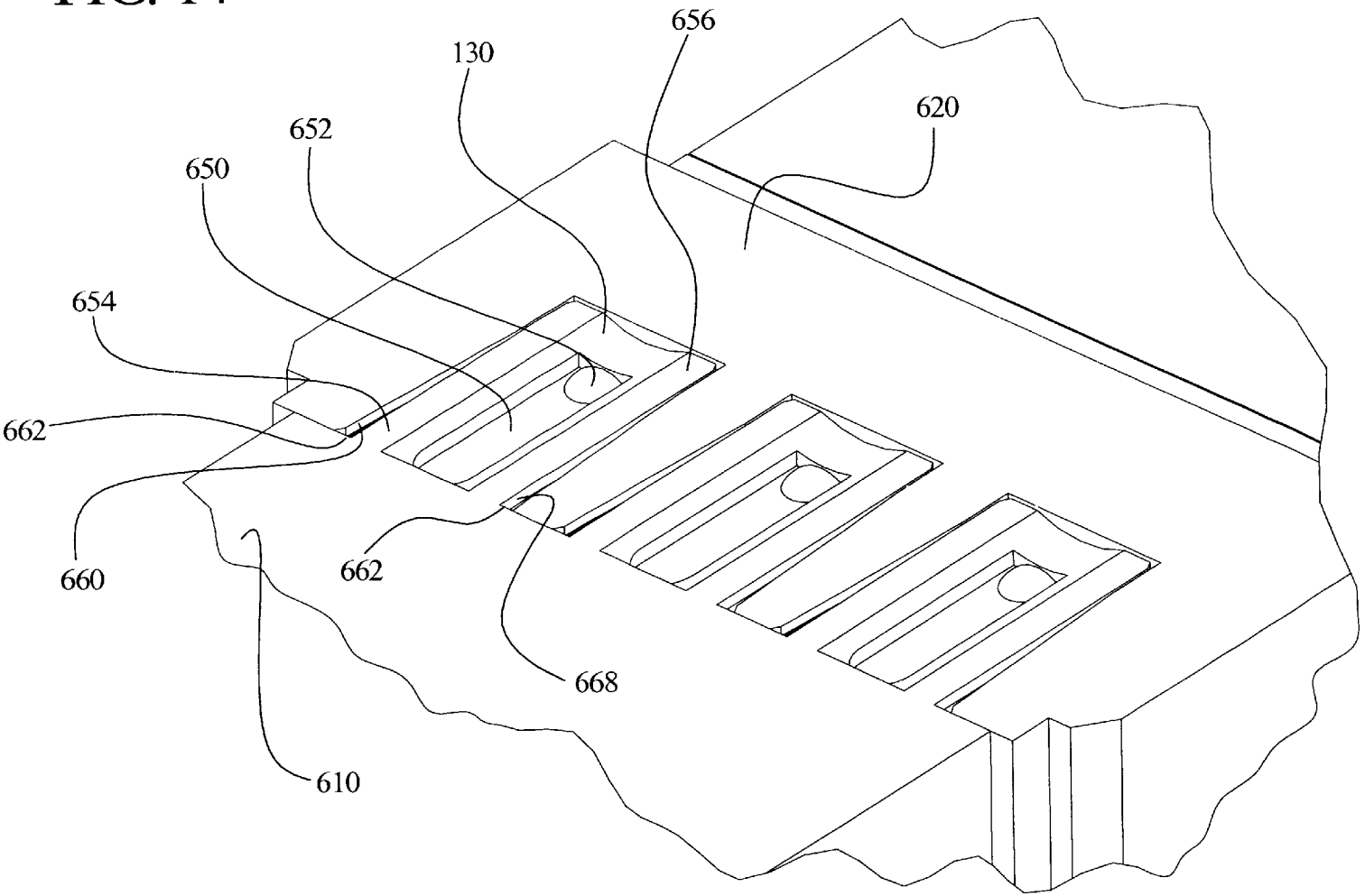
FIG. 14 is an isometric view of a latching system formed in accordance with an embodiment of the present invention.

FIG. 14 is an isometric view of a latching system formed in accordance with an embodiment of the present invention. The latching system shown in FIG. 14 may be used with the receptacle connector 100 and/or the plug connector 200. As shown in FIG. 14, the latch recesses 650 include clearance areas 662 defined between side walls 668 of the latch members 130 and the latch flexion limiting lips 660. The clearance areas 662 provide an area over which the latch members 130 may move in relation to the floating interface 620. The clearance areas 662 are wider proximate the flex ends 654 of the latch members as compared to the retained areas 656. That is, the latch members 130 are more securely retained at their retained ends 656 as compared to their flex ends 654. The floating interface housing 620 moves in response to the movement of the flex portions 112 of the receptacle wafers 110. That is, movement of the floating interface housing 620 through the clearance areas 662 causes a corresponding relative movement in the latch members 130. That is, the cover 610 and base 120 remain stationary while the floating interface housing 620 moves.

Movement between the latch member 130 and the latch flexion limiting lips 660 is relative to the actual movement of the floating interface housing 620. However, relative movement of the latch member 130 is limited by the latch flexion limiting lips 660. That is, as the latch members 130 contact the latch flexion limiting lips 660, continued movement of the floating interface 620 in that direction is arrested.

Figure 7:
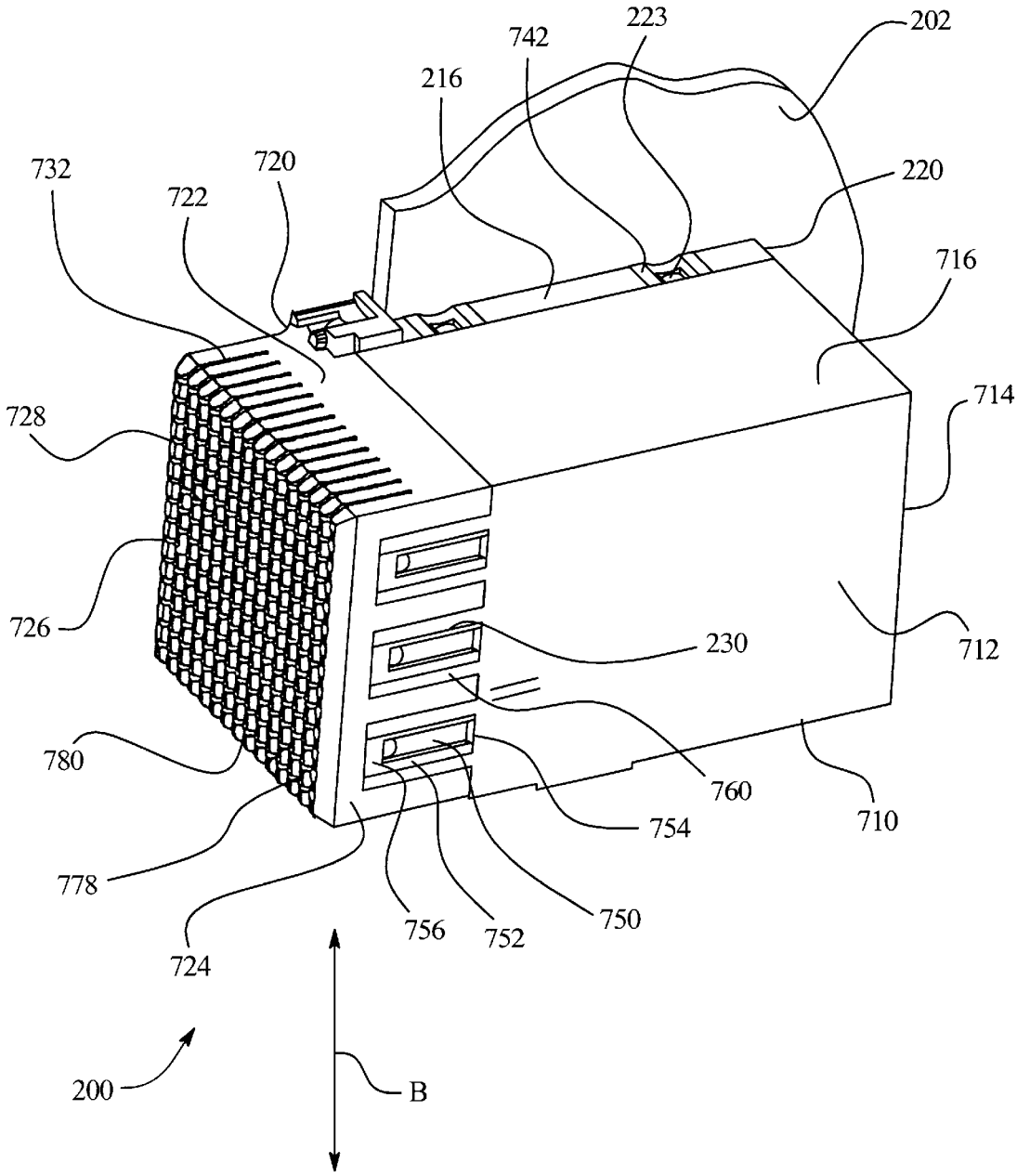
FIG. 7 is an isometric view of a plug connector formed in accordance with an embodiment of the present invention.

FIG. 7 is an isometric view of a plug connector 200, without plug wafers 110, formed in accordance with an embodiment of the present invention. The plug connector 200 includes the base 220, a floating interface housing 720 and a cover 710. The floating interface housing 720 has latch recesses 750 having latch projections 752, latch flexion limiting lips 760, side walls 722, a top wall 724, a bottom wall 726 and an interface wall 728. The latch recesses 750 and latch projections 752 are formed on the exterior of the top wall 724 and the bottom wall 726. At least one of the side walls 722 includes slots 732 extending from the interface wall 728. The slots 732 securely retain the interface portions 217 of the plug wafers 210. Thus, upon complete assembly of the plug connector 200, each plug wafer 210 is fixed at its rear portion 213 and its interface portion 217. Only the flex portion 212 of each plug wafer 210 flexes, while the rear portion 213 and the interface portion 217 remain relatively rigid and straight as compared to the flex portion 212. However, as mentioned above, while the interface portion 217 remains in a straight orientation, the interface portion 217 moves in response to the flexing of the flex portion 112.

The plug wafers 210, however, do not pass through the interface wall 728. Rather, the interface wall 728 includes guide members 780 that support and align the single beam receptacle interconnects 14 of the ground terminals 22 and the double beam receptacle interconnects 24 of the signal terminals 22 so that they may pass through channels 778 formed within the interface wall 728. The single beam receptacle interconnects 14 and the double beam receptacle interconnects 24 are exposed and may mate with contact pads on receptacle wafers 110 when the plug connector 200 mates with the receptacle connector 100.

The cover 710 includes a top wall 712, side walls 716, a rear wall 714, latch members 230 and cover latches 742. An open cavity (not shown) is defined by the walls 712, 716 and 714. In FIG. 7, the latch mating members 223 and cover mating notches 222 are formed on the side walls 216 of the base 220. As shown in FIG. 2, however, the latch mating members 223 and cover mating notches 222 may be formed on the rear wall 208 of the base 220. Alternatively, these features may be located on the side walls 216 and the rear wall 208. The cover latches 742 are oriented on the cover 710 to correspond to the position(s) of the cover mating notches 222 and the latch mating members 223. The cover latches 742 are received by the cover mating notches 222 and retained by the latch mating members 223. Optionally, instead of using a latching system to fasten the cover 710 to the base 220, the cover 222 may be fastened to the base 220 through screws, glue, and the like.

The latch members 230 may be integrally formed with the top wall 712 of the cover 710, or they may be separately mounted on the top wall 712. The latch members 230 on the cover 710 and on the base 220 have a flex end 754 and a retained end 756. The latch members 230 engage the latch recesses 750 and mate with the latch projections 752. The retained ends 756, which are retained by the latch recesses 750, remain fixed while the flex ends 754 may move, relative to the actual movement of the floating interface housing 720, in the directions denoted by line B. That is, the flex ends 754, because they are connected, or formed integrally with the stationary cover 710 or base 220, do not actually move. The floating interface housing 720 moves, which produces relative motion between the flex ends 754 and the floating interface housing 720. The movement of the flex ends 754 is limited by the latch flexion limiting lips 760. As mentioned above, the movement of the latching system used with the plug connector 200 is similar to that used with the receptacle connector 100. When the movement of the floating interface housing 720 causes the flex ends 754 of the latch members 230 to contact the latch flexion limiting lips 760, continued movement of the floating interface in that direction is arrested.

The receptacle connector 100 is mated with the plug connector 200 so that electrical signals may travel from plug wafers 210 to receptacle wafers 110, and vice versa. That is, the receptacle connector 100 receives and snapably retains the plug connector 200, such that the receptacle wafers 110 orthogonally mate with the plug wafers 210, as shown in FIG. 5. The mating of the receptacle connector 100 with the plug connector 200 provides contact alignment correction over all angles and orientations because the floating interface 620 of the receptacle connector 100 may move over a horizontal plane (denoted by line A) and the floating interface 720 of the plug connector 200 may move over a vertical plane (denoted by line B). Thus, vertical misalignment, horizontal misalignment, or combinations of both, may be corrected through the floating interface housings 620 and 720 of the receptacle and plug connectors 100 and 200, respectively.

Figure 10:
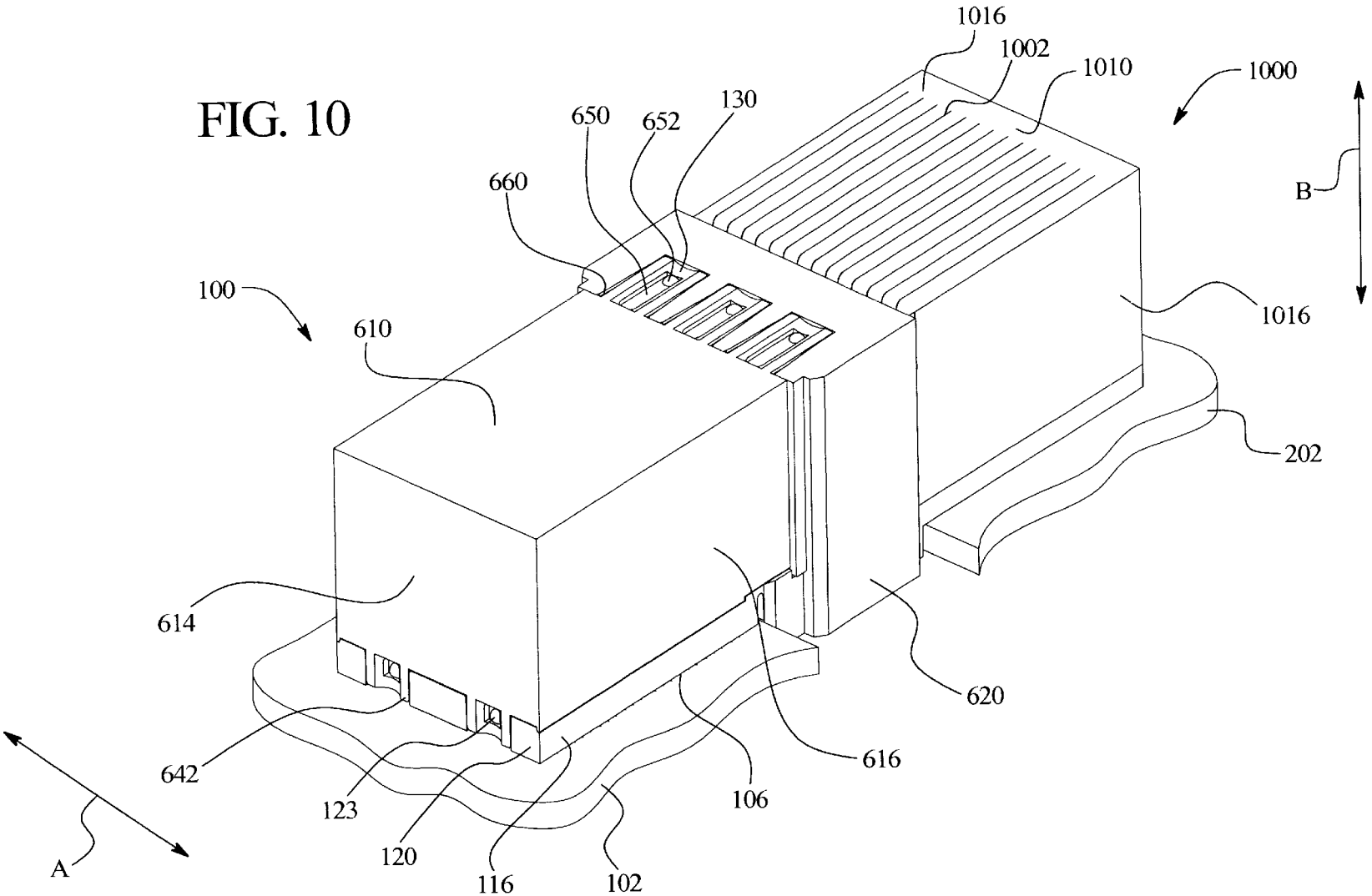
FIG. 10 is an isometric view of a receptacle connector mated in a coplanar fashion with a plug connector, according to an embodiment of the present invention.

The floating interface configuration may also be used with an electrical connector that mates plug and receptacle wafers in a coplanar fashion. That is, the plug and receptacle wafers are not orthogonally mated. FIG. 10 is an isometric view of the receptacle connector 100 mating in a coplanar fashion with a plug connector 1000, according to an embodiment of the present invention. The plug connector 1000 includes many of the same features as the plug connector 200, as described above, except it has wafer slots 1002 formed on a top housing 1016 of the cover 1010. Alternatively, the wafer slots 1002 may not be included within the top housing 1016. The wafer slots 1002 assist in retaining the plug wafers (not shown). Both the receptacle wafers 110 and the plug wafers, in this embodiment, are aligned in a coplanar fashion. That is, the receptacle wafer 110 that mates with its corresponding plug wafer is initially aligned in the same plane as the plug wafer. The interface housing 620 of the receptacle connector 100 may move in the directions denoted by Line A, while the interface housing (covered by the interface housing 620 of the receptacle connector 100) of the plug housing 1000 may move in the directions denoted by Line B.

Figure 11:
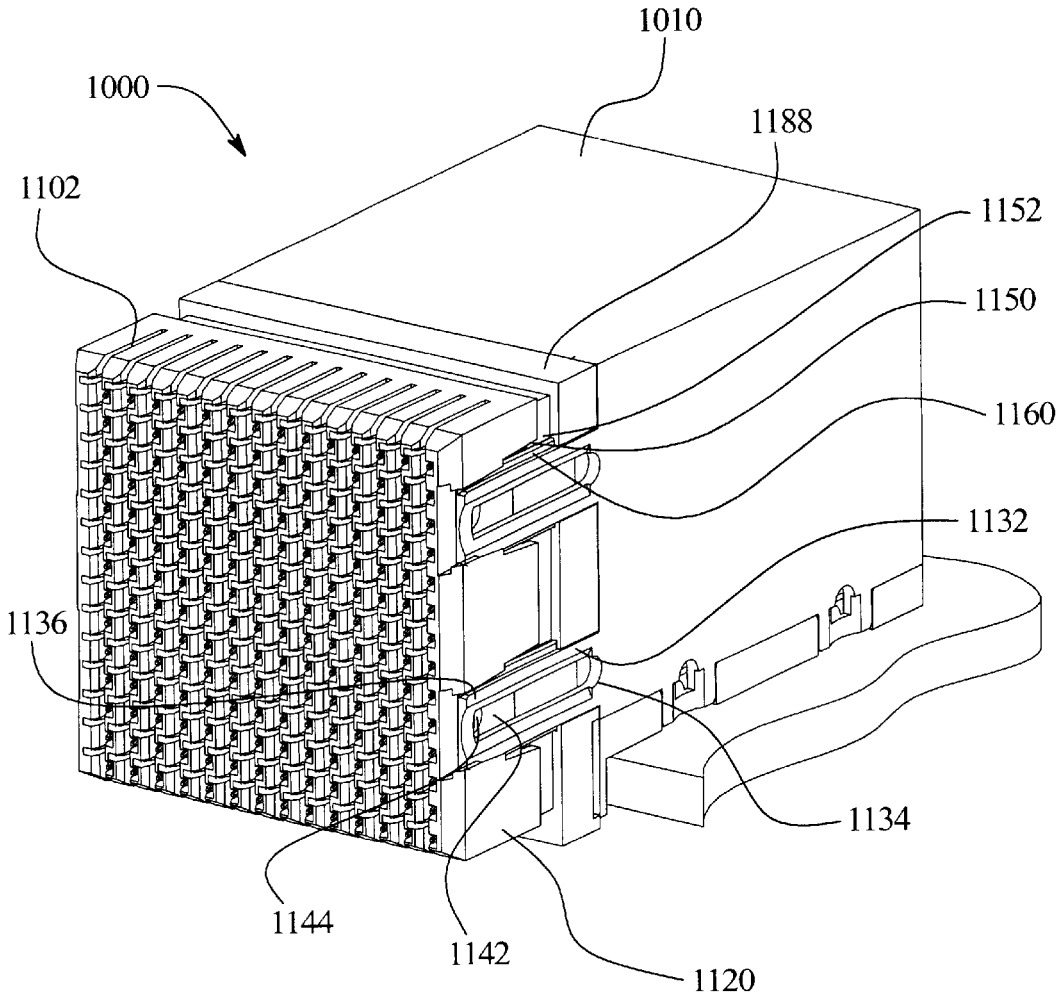
FIG. 11 is an isometric view of a plug connector according to an embodiment of the present invention.

FIG. 11 is an isometric view of a plug connector 1000 according to an embodiment of the present invention. As shown in FIG. 11, the plug connector 1000 does not have the wafer slots formed in the top housing 1016 of the cover 1010. Rather, wafer slots 1102 are formed in the floating interface housing 1120. The plug connector 1000 includes an alternative latching system. The floating interface housing 1120 includes a latching recess 1142 and a latching projection 1144. The cover 1010 includes a latching member 1132 having a flex end 1134 and a retained end 1136. The movement of the latching member 1132 and the latching projection 1144 function in a similar way as those described above with respect to FIGS. 1–9. However, the floating interface 1120 also includes a float-limiting divot 1150 and a float-limiting wall 1152. Additionally, the latching member 1132 includes an abutting member 1160 that may move through the float-limiting divot 1150 until it abuts the floating limiting wall 1152. Thus, the movement of the latching member 1132 is limited by the float limiting walls 1152. Additionally, as shown in FIG. 11, a stationary intermediate piece 1188 may be used to ensure that the cover 1010 does not move. The alternative latching system shown in FIG. 11 may also be used with the receptacle connector 100 or the plug connector 200.

Alternatively, various engagement systems may be used with the connectors 100, 200 and 1000 in lieu of the latching systems described. For example, a guide track system may be used in which an interface housing includes guide track (s) and the corresponding cover includes channel(s) that receive the guide track. The interface housing may then slide along the channel(s) on the guide tracks(s). Additionally, stop blocks may be positioned on the guide track(s) and/or channel(s) that limit the movement of the interface housing. Optionally, the guide tracks may either be smooth or include a gear system in which the guide track has gear teeth that are engaged by a gear, or cog. Also, alternatively, instead of using a latching system, fasteners, such as screws, may be used. That is, the interface housing may be screwed to the cover such that the interface housing may move over the cover. For example, the interface housing may be screwed to the cover at a mid point of the top wall of the interface housing, and the interface housing may be screwed to the base at a mid point of the bottom wall of the interface housing. The two screws would be positioned along the same axis, thereby providing a rotational axis over which the interface housing may move. A clearance area between the interface housing and the cover may also be used to provide additional range of motion.

Figure 12:
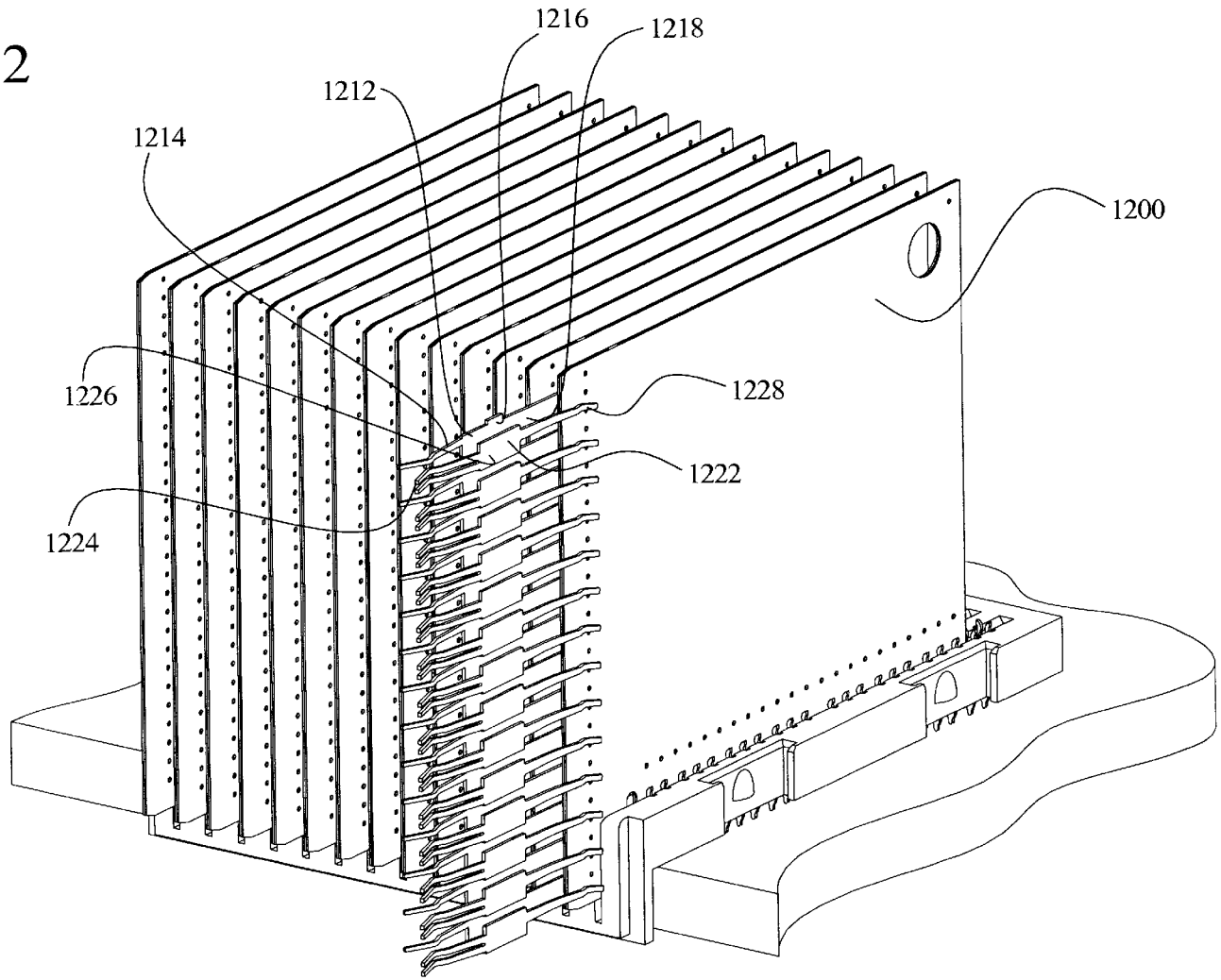
FIG. 12 is an isometric view of an interior of a plug connector according to an embodiment of the present invention.

FIG. 12 is an isometric view of an interior of the plug connector 1000 according to an embodiment of the present invention. The plug wafers 1200 are connected to signal terminals 1222 and ground terminals 1212. Each signal terminal 1222 includes a double beam receptacle interconnect 1224 extending from an intermediate portion 1226, and a single beam plug signal interconnect 1228 extending from an opposite end of the intermediate portion 1226. Each double beam receptacle interconnect 1224 connects to one side of a receptacle wafer (not shown), while each single beam plug signal interconnect 1228 connects to one side of a plug wafer 1200. Each ground terminal 1212 includes a single beam receptacle interconnect 1214 extending from an intermediate portion 1216 connecting to a second side of a receptacle wafer (not shown) and a wide plug ground interconnect 1218, which connects to one side of a plug wafer 1200. The plug ground interconnect is wider than the plug signal interconnect 1228.

Figure 13:
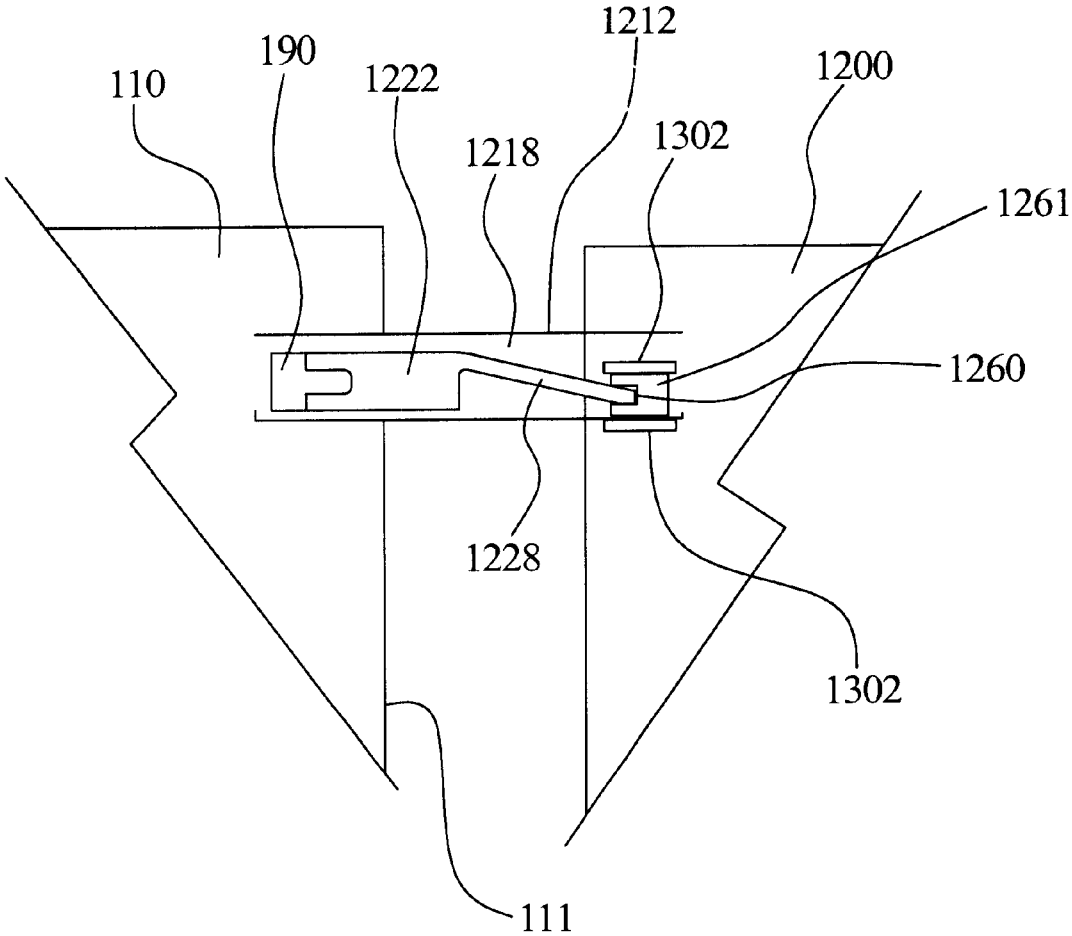
FIG. 13 is a side view illustrating movement of signal and ground terminals during an upward shift of a receptacle wafer, according to an embodiment of the present invention.

FIG. 13 is a side view illustrating movement of signal and ground terminals 1222 and 1212 during an upward shift of a receptacle wafer 110, according to an embodiment of the present invention. As shown in FIG. 13, when a receptacle wafer moves, for example, in the up direction, and the plug wafer 1200 remains stationary, the plug signal interconnect 1228, the movement of which is limited by stop blocks 1302, pivots, in a cantilever fashion, due to the movement of the receptacle wafer 110. The stop blocks 1302 may be formations that outwardly extend from the plug wafer 1200. A retained end 1260 of a plug signal interconnect 1228 engages a signal contact pad 1261, which is positioned between two stop blocks 1302. The retained end 1260 is positioned between two signal blocks 1302. Thus, the movement of the receptacle wafer 110 shifts the plug signal interconnect 1228 out of a level orientation. Conversely, the ground terminal 1212 remains in a level orientation because the ground terminal 1212 slides up or down on the plug wafer 1200 in response to the movement of the receptacle wafer 110. Because, however, the plug ground interconnect 1218 is wider than the plug signal interconnect 1228, the plug ground interconnect 1218 is able to shield the plug signal interconnect 1228 from other plug signal interconnects 1228 despite the cantilever movement of the plug signal interconnects 1228.

Thus certain embodiments of the present invention provide an electrical connector that maintains proper contact between electrical wafers included within a first connector and those in a second connector, whether the wafers of the first connector mate orthogonally, or in a coplanar fashion with those of thee second connector. Further, certain embodiments of the present invention provide an electrical connector that maintains proper alignment and corrects misalignments between circuit boards, or wafers, within a first connector and those of a second connector housing.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector, comprising:

a housing having a rear end and an interface end; and a conductive wafer configured to engage electrical contacts, said conductive wafer having a plurality of holes separating said conductive wafer into a rear portion and an interface portion, said rear portion remaining rigid and straight in a wafer plane, said rear portion being held in said housing with said interface portion extending beyond said interface end of said housing, said interface portion including a contact edge, said interface portion moving along said plurality of holes relative to said rear portion in a direction transverse to said wafer plane of said rear portion.

2. The electrical connector of claim 1 further comprising an interface housing, said interface housing receiving and securely retaining said interface portion of said conductive wafer, said interface housing moving in said direction transverse to said wafer plane of said rear portion, with said interface portion, in response to movement of said interface portion.

3. The electrical connector of claim 1 further comprising a plurality of conductive wafers, each of said plurality of conductive wafers having a rear portion and an interface portion, said plurality of conductive wafers being aligned parallel to one another, each of said interface portions of said plurality of said conductive wafers moving with respect to a corresponding rear portion in said direction transverse to a corresponding wafer plane of said corresponding rear portion.

4. The electrical connector of claim 1 wherein said housing further comprises flex limiting wedges positioned on either side of said wafer at said interface end, said flex limiting wedges defining a range of motion over which said interface portion moves.

5. The electrical connector of claim 1 wherein said housing further comprises a base and a cover latchably secured to one another to enclose said conductive wafer.

6. The electrical connector of claim 1 wherein said rear and interface portions are separated by at least one row of holes through said conductive wafer, said at least one row of holes being located beyond said interface end of said housing, said interface portion moving relative to said rear portion along said at least one row of holes.

7. An electrical connector, comprising:

a housing having a base having a rear end and an interface end, said base including a channel extending between said rear and interface ends; and a conductive wafer configured to engage electrical contacts, said conductive wafer being divided into a rear portion and an interface portion, said rear portion being received and securely retained in said channel with said interface portion extending beyond said interface end of said base, said interface portion including a contact edge, said interface portion moving in a direction transverse to a plane of said conductive wafer to facilitate alignment with a mating structure, wherein said conductive wafer further comprises a flex portion between said rear and interface portions defined by at least one of columns and rows of holes through said conductive wafer, said flex portion flexing to cause said interface portion to move in said direction transverse to said plane of said conductive wafer.

8. A connector assembly comprising:

a plug connector mated with a receptacle connector, each of said plug and receptacle connectors comprising:

a housing having an interface end; and a conductive wafer divided into a rear portion and an interface portion by at least one of a column and a row of holes through said conductive wafer, said rear portion being received in said housing with said interface portion located proximate said interface end of said housing, said interface portion moving in a direction transverse to a plane of said rear portion.

9. The connector assembly of claim 8 wherein said conductive wafer further comprises a flex portion between said rear and interface portions defined by at least one of columns and rows of holes through said conductive wafer, said flex portion flexing to cause said interface portion to move in said direction transverse to said plane of said conductive wafer.

10. The connector assembly of claim 8 further including signal and ground terminals, said conductive wafer in said plug connector connecting to said conductive wafer in said receptacle connector through said signal and ground terminals, said signal and ground terminals include prongs that contact said conductive wafer of said plug connector, said prongs flexing in response to movement of said interface portion.

11. The system of claim 8 further including signal and ground terminals, said conductive wafer in said plug connector connecting to said conductive wafer in said receptacle connector through said signal and ground terminals, wherein said signal and ground terminals move in a cantilever fashion in response to movement of said interface portion.

12. The system of claim 8 further including a signal terminal and a ground terminal, said conductive wafer in said plug connector connecting to said conductive wafer in said receptacle connector through said signal terminal and said ground terminal, wherein said signal terminal moves in a cantilever fashion in response to movement of said interface portion, and said ground terminal maintains a level orientation when said ground terminal moves in response to said movement of said interface portion.

13. The connector assembly of claim 8 wherein each of said plug connector and said receptacle connector further comprise an interface housing located at said interface end of said housing, said interface housing receiving and securely retaining said interface portion of said conductive wafer, said interface housing moving relative to said housing in said direction transverse to said plane of said rear portion, with said interface portion, in response to movement of said interface portion.

14. The connector assembly of claim 8 wherein each of said plug connector and said receptacle connector further comprise a plurality of conductive wafers, each of said plurality of conductive wafers having a rear portion and an interface portion, said plurality of conductive wafers being aligned parallel to one another, said interface portions of said plurality of said conductive wafers moving in said direction transverse to said plane of said rear portions.

15. The connector assembly of claim 8 wherein said housing further comprises flex limiting wedges positioned on either side of said wafer at said interface end, said flex limiting wedges defining a range of motion over which said interface portion move.

16. The connector assembly of claim 8 wherein said housing further comprises a base and a cover latchably secured to one another to enclose said conductive wafers.

17. A connector assembly comprising:

a plug connector mated with a receptacle connector, each of said plug and receptacle connectors comprising:

a housing having an interface end; and a conductive wafer divided into a rear portion and an interface portion, said rear portion being received in said housing with said interface portion located proximate said interface end of said housing, said interface portion moving in a direction transverse to a plane of said conductive wafer, wherein said rear and interface portions are separated by at least one row of holes through said conductive wafer, said wafer flexing at said at least one row of holes.

18. A connector assembly comprising:

a plug connector mated with a receptacle connector, each of said plug and receptacle connectors comprising:

a housing having an interface end; and a conductive wafer configured to engage electrical contacts, said conductive wafer being divided into a rear portion and an interface portion, said rear portion being received in said housing with said interface portion extending beyond said interface end of said housing, said interface portion including a contact edge, said interface portion moving in a direction transverse to a plane of said conductive wafer, said interface portions of said conductive wafers in said plug connector and said receptacle connector moving along first and second directions, respectively, said first direction being perpendicular to said second direction.

19. A connector assembly comprising:

a plug connector mated with a receptacle connector, each of said plug and receptacle connectors comprising:

a housing having an interface end; and a conductive wafer divided into a rear portion and an interface portion, said rear portion being received in said housing with said interface portion located proximate said interface end of said housing, said interface portion moving in a direction transverse to a plane of said conductive wafer, wherein said conductive wafer in said plug connector is oriented parallel to a first plane, and said conductive wafer in said receptacle connector is oriented parallel to a second plane that is perpendicular to said first plane, said conductive wafer of said plug connector orthogonally mating with said conductive wafer of said receptacle connector.

20. A connector assembly comprising:

a plug connector mated with a receptacle connector, each of said plug and receptacle connectors comprising:

a housing having an interface end;

a conductive wafer configured to engage electrical contacts, said conductive wafer being divided into a rear portion and an interface portion by at least one of a column and a row of holes through said conductive wafer, said rear portion being received in said housing with said interface portion extending beyond said interface end of said housing, said interface portion including a contact edge, said interface portion moving in a direction transverse to a plane of said conductive wafer to facilitate alignment with a mating structure; and signal and ground terminals, said conductive wafer in said plug connector connecting to said conductive wafer in said receptacle connector through said signal and ground terminals.

21. A connector assembly comprising:

a first connector mated with a second connector, each of said first and second connectors comprising:

a housing having a base having a rear end and an interface end, said base including a channel extending between said rear and interface ends;

a conductive wafer configured to engage electrical contacts said conductive wafer being divided into a rear portion and an interface portion, said rear portion being received and securely retained in said channel with said interface portion extending beyond said interface end of said base, said interface portion including a contact edge, said interface portion moving in a direction transverse to a plane of said conductive wafer to facilitate alignment with a mating structure;

flex limiting wedges positioned on either side of said channel at said interface end, said flex limiting wedges defining a range of motion over which said interface portion moves; and an interface housing, said interface housing receiving and securely retaining said interface portion of said conductive wafer, said interface housing moving in said direction with said interface portion in response to a movement of said interface portion.

22. The connector assembly of claim 21 wherein each of said first connector and said second connector further comprise a plurality of conductive wafers and a plurality of channels in said base, each of said plurality of conductive wafers having a rear portion and an interface portion, said plurality of conductive wafers being aligned parallel to one another, said interface portions of said plurality of said conductive wafers moving in said direction.

23. The connector assembly of claim 21 wherein said housing further comprises a cover latchably secured to said base to enclose said conductive wafers.

24. The connector assembly of claim 21 wherein said rear and interface portions are separated by at least one row of holes through said conductive wafer, said at least one row of holes being aligned along a line extending parallel to said contact edge.

25. The connector assembly of claim 21 wherein said conductive wafer further comprises a flex portion between said rear and interface portions defined by at least one of columns and rows of holes through said conductive wafer, said flex portion flexing to cause said interface portion to move in said direction transverse to said plane of said conductive wafer.

26. The connector assembly of claim 8 wherein said conductive wafers in said first connector and said second connector move along first and second directions, respectively, said first direction being perpendicular to said second direction.

27. The connector assembly of claim 21 wherein said conductive wafer in said first connector is oriented parallel to a first plane, and said conductive wafer in said second connector is oriented parallel to a second plane that is perpendicular to said first plane, said conductive wafer of said first connector orthogonally mating with said conductive wafer of said second connector.

28. The connector assembly of claim 21 further including signal and ground terminals, said conductive wafer in said first connector connecting to said conductive wafer in said second connector through said signal and ground terminals.

29. The connector assembly of claim 21 further including signal and ground terminals, said conductive wafer in said first connector connecting to said conductive wafer in said second connector through said signal and ground terminals, said signal and ground terminals include prongs that contact said conductive wafer of said first connector, said prongs flexing in response to movement of said interface portion.

30. The system of claim 21 further including signal and ground terminals, said conductive wafer in said first connector connecting to said conductive wafer in said second connector through said signal and ground terminals, wherein said signal and ground terminals move in a cantilever fashion in response to movement of said interface portion.

31. The system of claim 21 further including signal and ground terminals, said conductive wafer in said first connector connecting to said conductive wafer in said second connector through said signal and ground terminals, wherein said signal terminal moves in a cantilever fashion in response to movement of said interface portion, and said ground terminal maintains a level orientation when said ground terminal moves in response to said movement of said interface portion.

32. An electrical connector, comprising:

a housing having an interface end; and a conductive wafer divided into a rear portion, a flex portion and a interface portion, said flex portion containing a plurality of holes through said conductive waver that are provided between said rear and interface portions, said rear portion being received in said housing with said flex and interface portions located proximate said interface end, said flex portion flexing to permit said interface portion to move relative to said rear portion.

33. The connector assembly of claim 32, wherein said flex portion includes a row of flex holes.

34. A connector assembly, comprising:

a housing having an interface end; and a conductive wafer received in said housing, said wafer being divided into a rear portion and an interface portion by at least a row of flex holes through said conductive wafer, said flex holes flexing to permit said interface portion to move relative to said rear portion, wherein said interface portion located proximate said interface end.

35. The connector assembly of claim 33, wherein said interface portion remains rigid and straight when said interface portion moves relative to said rear portion along said flex holes.

* * * * *